US012708243B2

(12) United States Patent
Bukowski et al.

(10) Patent No.: US 12,708,243 B2
(45) Date of Patent: Aug. 18, 2026

(54) FLOOR TREATMENT MACHINE

(71) Applicant: NUMATIC INTERNATIONAL LIMITED, Camberley (GB)

(72) Inventors: Piotr Bukowski, Chard (GB); Nicholas Putt, Chard (GB)

(73) Assignee: Numatic International Limited

( * ) Notice: Subject to any disclaimer, the term of this patent is extended or adjusted under 35 U.S.C. 154(b) by 227 days.

(21) Appl. No.: 18/707,390

(22) PCT Filed: Nov. 5, 2021

(86) PCT No.: PCT/GB2021/052883
§ 371 (c)(1),
(2) Date: May 3, 2024

(87) PCT Pub. No.: WO2023/079253
PCT Pub. Date: May 11, 2023

(65) Prior Publication Data

US 2026/0165549 A1 Jun. 18, 2026

(51) Int. Cl.
*A47L 11/08* (2006.01)
*A47L 11/202* (2006.01)

(52) U.S. Cl.
CPC ..... *A47L 11/2025* (2013.01); *A47L 11/08* (2013.01)

(58) Field of Classification Search
CPC .... A47L 11/2025; A47L 11/08; A47L 11/085; A47L 11/16; A47L 11/161; A47L 11/283;
(Continued)

(56) References Cited

U.S. PATENT DOCUMENTS 1,856,875 A * 5/1932 Leonard ..... A47L 9/068 15/328
4,122,576 A * 10/1978 Bevington ..... A47L 11/162 15/49.1

(Continued)

FOREIGN PATENT DOCUMENTS

CN 112741570 A * 5/2021 ..... A47L 11/305
CN 114423322 A * 4/2022 ..... A47L 11/4075

(Continued)

OTHER PUBLICATIONS

International Search Report and Written Opinion in International Application No. PCT/GB2021/052883, Aug. 8, 2022, 9 pages.

*Primary Examiner* — Monica L Perry
(74) *Attorney, Agent, or Firm* — Victor Cardona, Esq; Heslin Rothenberg Farley & Mesiti P.C.

(57) ABSTRACT

A floor treatment machine has a base portion with two or more rotatable generally disc-shaped floor-facing work heads arranged side-by-side on the floor and each having a generally vertical axis of rotation, the machine having drive means for rotatably driving the work heads in counter-rotation with respect to one another, and wherein the rotational axes of both work heads are tilted transversely from their respective verticals so that the axes are convergent or divergent in opposite transverse directions thereby causing the work heads to adopt dihedral or dihedral configurations when viewed from a front of the machine, which configurations in use provide propulsion of the machine over the floor surface, wherein the respective work head axes are both tilted backwards away from the vertical so that both work heads are tilted-up at front end regions thereof and depressed at rear end regions thereof with respect to the floor surface.

17 Claims, 5 Drawing Sheets

(58) Field of Classification Search
CPC .. A47L 11/305; A47L 11/4038; A47L 11/302; A47L 11/4016; A47L 11/20; A47L 11/201; A47L 11/26; A47L 11/202; A47L 11/4052; A47L 7/02; A46B 13/04; A46B 13/008
See application file for complete search history.

(56) References Cited

U.S. PATENT DOCUMENTS 4,218,798 A * 8/1980 Block ..... A47L 11/4058 15/49.1
5,849,097 A * 12/1998 Windmeisser ..... A47L 11/4038 15/49.1
6,550,099 B2 * 4/2003 Worwag ..... A47L 9/0416 15/387
6,783,600 B2 * 8/2004 Tawara ..... A47L 11/4077 15/98
8,161,595 B1 * 4/2012 Wilson ..... A47L 11/4083 15/327.2
8,887,348 B2 * 11/2014 Kenter ..... A47L 11/4016 15/98
9,826,874 B2 * 11/2017 Franke ..... A47L 11/4072
11,297,993 B2 * 4/2022 Franke ..... A47L 11/4044
11,771,292 B1 * 10/2023 Bisson ..... A47L 11/4055 15/28
12,433,464 B2 * 10/2025 Wiltshire ..... A47L 11/283
2005/0166356 A1 * 8/2005 Uehigashi ..... A47L 11/4038 15/319
2012/0110775 A1 * 5/2012 Krebs ..... A47L 9/0472 15/347
2012/0233804 A1 * 9/2012 Studebaker ..... A47L 11/161 15/322
2019/0038101 A1 * 2/2019 Jang ..... A47L 11/24
2022/0330776 A1 * 10/2022 Wiltshire ..... A47L 11/16
2024/0081601 A1 * 3/2024 Bukowski ..... A47L 11/4088
2024/0341555 A1 * 10/2024 Fooks ..... A47L 11/16

FOREIGN PATENT DOCUMENTS

ES 2940329 T3 * 5/2023 ..... A47L 11/4091
GB 2605743 A * 10/2022 ..... A47L 11/4072
KR 101595727 B1 2/2016
WO 2018012921 A1 1/2018

* cited by examiner

FLOOR TREATMENT MACHINE

CROSS REFERENCE TO RELATED APPLICATIONS

This application is a U.S. National Phase filing under 35 U.S.C. § 371 of International Application PCT/GB2021/052883, filed Nov. 5, 2021, and published as WO2023/079253A1 on May 11, 2023. The entire contents of each of these prior applications are hereby incorporated herein by reference.

The present invention concerns the field of floor treatment machines such as scrubbers, finishers or polishers. Floor scrubbers typically have rotating work heads equipped with bristles for working the floor to remove dirt. Finishers may have stiffer bristles with which to pare down a floor surface, such as a wooden surface. Polishers are typically equipped with relatively soft cleaning pads for polishing floor surfaces such as varnished wooden, polymer (e.g. linoleum) or concrete/ceramic surfaces.

The present invention in particular concerns polishing machines having at least two floor-facing generally disc shaped work heads. These work heads typically have a generally vertical axes of rotation. Where there are two work heads they are typically arranged to be counter rotating so as to balance any tendency for generating torque reaction which results in a net force parallel to the floor, causing unintended travel or drift of the machine which carries the work heads. One example of a machine having counter rotating balanced work heads is described in U.S. Pat. No. 8,887,348B2 (2014). This machine is especially prone to torque induced drift because the weight of the machine is taken entirely by the two work heads, with no support wheels to provide directional stability. Thus, the machine has a tendency to drift if asymmetries between brushes arise, such as in brush wear or slight variations in the respective axes or rotation. U.S. Pat. No. 9,826,874B2 discloses a similar machine having a base portion or deck supported by two counter-rotating work heads. However, in this case the work heads have axes of rotation that are deliberately inclined slightly from the vertical so as to be convergent in a transverse direction. In other words, the two side by side work heads when viewed from the front exhibit a dihedral effect in the rotational planes. So the work heads have slightly lifted transverse outer edge regions and correspondingly depressed inter transverse inner edge regions (i.e. at the 3 and 9 O'clock regions of the work heads, where 12 O'clock is the working direction of the machine). Because the friction of the work head brushes is higher in the depressed inner edge regions, a permanent linear propulsion effect arises in the 12 O'clock working direction perpendicular to the transverse direction, when the inner depressed brush regions are both moving backwards towards the 6 O'clock position when rotating.

A problem arises in that the central adjacent regions of the work heads tend to exhibit enhanced cleaning/brushing due to the increased frictional pressure which arises. Conversely the outer regions have exert less pressure on the floor and therefore have a reduced cleaning or polishing effect.

The present invention seeks to address this issue of uneven cleaning in machines in which the work head brushes are utilised to provide propulsion over the floor surface.

According to one aspect of the invention there is provided a floor treatment machine comprising a base portion provided with two or more rotatable generally disc-shaped floor-facing work heads which are arranged side by side on the floor and each having a generally vertical axis of rotation, the machine being provided with drive means for rotatably driving the work heads in counter-rotation with respect to one another, and wherein the rotational axes of both work heads are tilted transversely from their respective verticals so that the axes are convergent or divergent in opposite transverse directions thereby causing the work heads to adopt dihedral or dihedral configurations when viewed from a front of the machine, which configurations in use provide propulsion of the machine over the floor surface, wherein the respective work head axes are also both tilted backwards away from the vertical so that both work heads are tilted-up at front end regions thereof and depressed at rear end regions thereof with respect to the floor surface.

The present inventors unexpectedly found that by providing a combination of transverse and rear wards tilt of the work heads the cleaning/scrubbing effect of the work heads can be enhanced across the rear of the work head, without compromising the propulsive effect of transverse tilting. Thus, the cleaned path is more effective across the full width of the two work heads.

In some embodiments the transverse tilt of work head axes is convergent so that work head pressure is enhanced at inner adjacent regions of each side-by-side work head. In these embodiments inner regions the work heads draw the treatment surface back over the underlying floor, so as to produce a propulsive reaction in a forwards treatment direction.

In other embodiments the transverse tilt of work head axes is divergent so that work head pressure is enhanced at opposite outer regions of each side-by-side work head. In these embodiments outer regions of the work heads draw the treatment surface back over the floor, so as to produce a propulsive reaction in a forwards treatment direction.

In either of the two cases above, the backwards tilt provides more uniform cleaning/scrubbing/polishing effect.

Suitable treatment surfaces include scrubbing brushes, typically comprising bristles arranged in an annular array around a central drive shaft chuck engagement. In this case the pressure applied to the rear of the work heads acts to retain cleaning liquid introduced into the work head within the annular brush rather than allowing it to escape immediately via the bristles. This reduces the amount of cleaning liquid required during a cleaning task. This is especially useful in wet scrubber driers such as described hereinafter.

Although scrubbing is a preferred treatment, polishing pads may be used, or more aggressive surfaces treatments such as wire or stiff brushes or grinding or sanding surfaces.

In a preferred aspect of the invention the work heads are carried underneath a deck portion of the machine. The deck portion may be used to support various other components of the machine, such as motors, transmissions, batteries, suction turbines. The deck portion may also be provided with a generally upstanding handle portion, preferably connected to the deck portion by pivoting connections which permit steering of the machine by a walk-behind operator. The deck portion is preferably configured to be tiltable with respect to the floor, whereby the work heads may also be tilted with the deck portion.

The deck portion may be provided with biasing means which act to tilt the deck portion up at a front region and down at a rear region thereof, thereby to provide at least a portion of the backwards tilt of the work head axes. This also maintains the beneficial downward pressure on the rear of the work heads.

The deck portion may be configured to be tiltable with respect to a portion of the machine that is supported on the floor by wheel means. The wheels means may comprise be one or more wheels or rollers which assist in travel of the machine over a floor surface.

A machine as claimed in claim 6 or claim 7 wherein a spring and or weight moment provides or supplements or modifies the deck portion tilt biasing.

In yet another aspect of the invention, the drive means may be disposed on the deck portion and provides or contributes or modifies the weight moment acting to bias the work heads into the tilted position, or away therefrom if need be. In a preferred arrangement each work head is attached to a drive shaft of a motor assembly for each work head. The motor assembly typically comprises an electric motor and a reduction gear transmission, provided as a self-contained unit in which a drive shaft protrudes for use in chuck-mounting a work head. The electric motor units may be offset relative to the drive shaft axes so as to provide a weight moment which biases the deck portion and work heads.

The (or each) motor assembly is in a preferred arrangement attached to the deck portion, typically an upper portion. One or more distributed spacer features may be interposed between the motor assembly and the deck portion act to provide a tilting effect of the drive shaft and work head with respect to the deck portion.

The machine is preferably configured as a scrubber drier with scrubbing brush attachments provided on the undersides of the work heads, a cleaning liquid reservoir, a cleaning liquid dispenser provided in advance of, or under, each work head, and a suction squeegee device configured to be trailed behind the work heads for collecting liquid-entrained dirt.

The machine may also include a dirty water collection tank into which the squeegee collector discharges.

The transverse tilt (of work heads or the work head rotational axes) may be in an amount of 0.5 to 3 degrees, preferably 0.8 to 1.5 degrees. Preferably the respective tilts are convergent.

The backwards tilt (of the work heads or the work head rotational axes) is in the range 2.0 to 5.0 degrees, preferably 2.5 to 4.0 degrees, most preferably 3.0 to 3.5 degrees.

The optimum tilt may be the subject or trial and error and may depend upon the nature of the scrubbing/work head agitation surface, and the floor surface and its roughness or degree of polish.

Following is a description by way of example only and with reference to the figures of the drawings of one mode for putting the present invention into effect.

Figure 1:
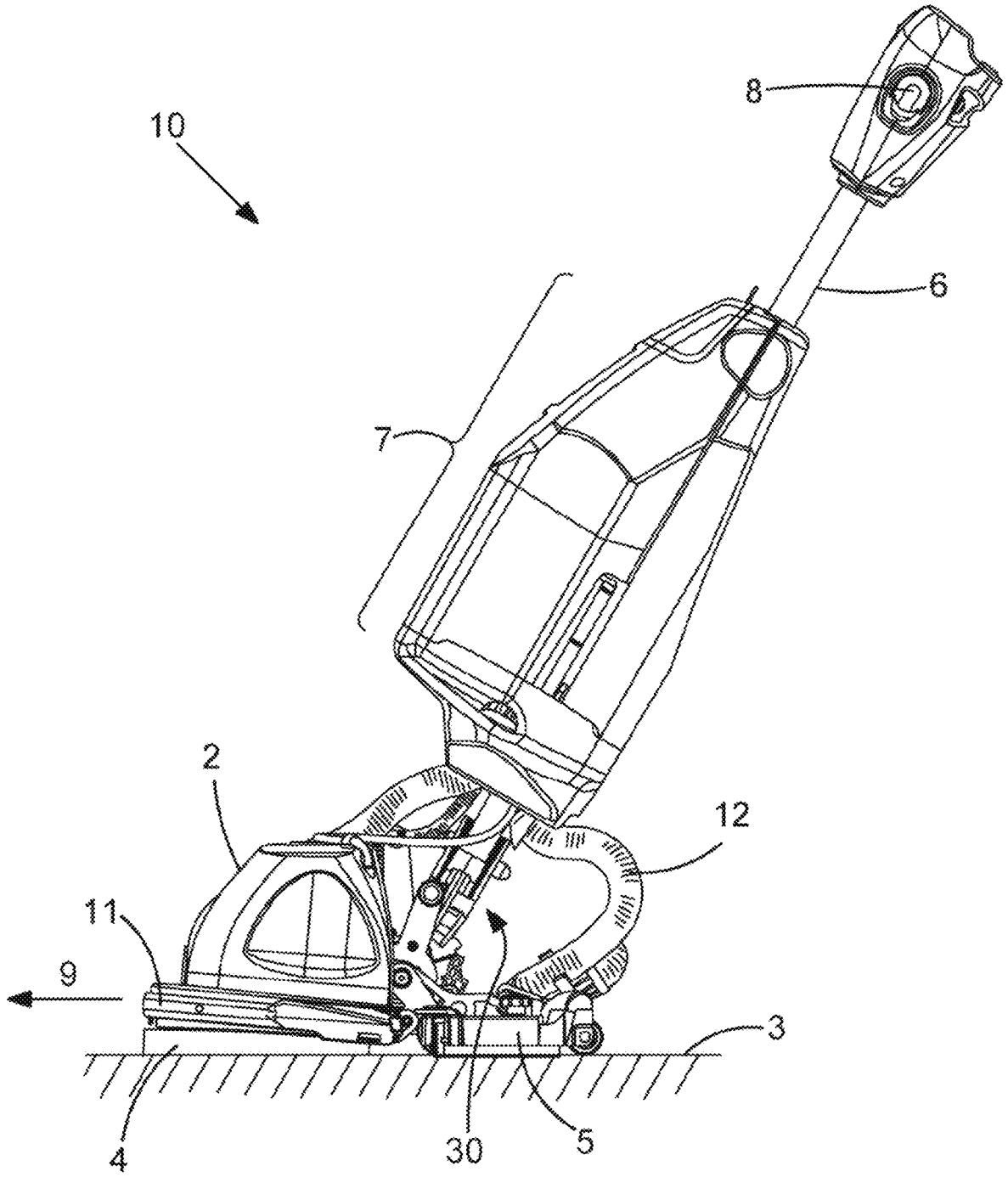
FIG. 1 is a side view of a floor scrubbing machine in accordance with the present invention, with a handle portion reclined to a use position.

The scrubbing machine in accordance with the invention is shown in FIG. 1 as 10 on floor 3. The configuration shown is a working configuration. The machine includes a deck portion 11, a motor housing 2, work heads 4 (one visible) and a squeegee suction collector 5, with suction pipe 12. There is an upstanding handle portion 6, with superstructure 7 in which is provided with a cleaning fluid reservoir and waste liquid collection tank. An upper region of the handle portion is provided with a cross bar 8 and controls such as an actuation lever. The machine is shown in a working or use configuration, with the handle portion reclined and the squeegee collector deployed on the floor surface. A lower end region of the machine is attached via a universal joint 30 (twin perpendicular pivots) articulation which permit up/down and side to side pivoting of the handle portion with respect to the base/deck of the machine. The working direction is shown as arrow 9. Rotation of the work heads causes the brushes 20 to scrub the floor. Cleaning liquid delivered to the floor assists in the cleaning effect. The dirty cleaning fluid is then collected behind work heads by the squeegee collector and discharged into the waste tank.

Figure 2:
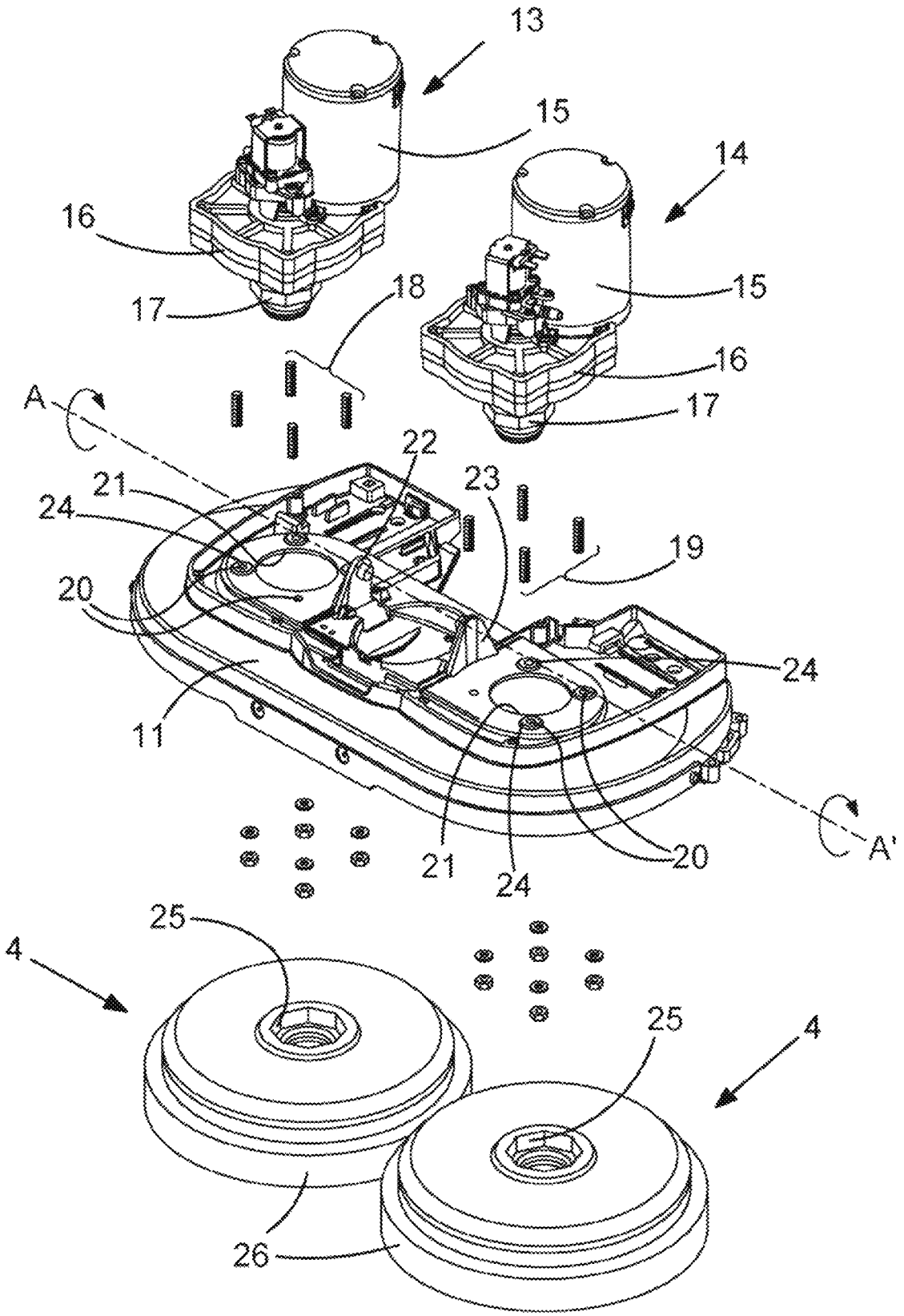
FIG. 2 is a threequarter perspective exploded view of the configuration of a deck assembly of the scrubbing machine.

In FIG. 2 the deck portion 11 and associated components are shown. There are two motor drive units 13, 14. Each motor drive unit comprises a generally cylindrical upright electric motor 15. The motors are engaged with a gearbox transmission assembly 16. A driven chuck 17 depends from an underside of each gearbox assembly. Two groups of four threaded pillars are shown at 18, 19. The pillars are interposed between the underside of each gearbox assembly (accommodated recessed bores) and four location holes 20 in the deck portion. The hole groups have three spacer washers 24 which control the spacing and alignment of the interface between the gearbox assemblies 16 and the deck. By changing the spacer positions, or omitting them, the angle of the drive shaft (which carries the chuck 17) and the deck can be fine-tuned. The threaded pillars are provided with nuts to fix the motor drive units in place on the deck. The deck portion is a generally C-plan assembly is formed with two circular, side-by-side cut-outs 21 in which are accommodated the depending chucks 17. Two transversely spaced apart upright brackets 22,23 are provided on an upper mid region of the deck portion. The brackets serve to permit tilting of the deck portion about the axis A-A' when the brackets are engaged with corresponding bushes in the machine. Two work heads 4 are shown in FIG. 2. The upper central region of the work heads is formed with an octagonal chuck seat 25 which receives the octagonal chuck 17. The chuck is typically fastened with a spring clip or some other releasable fastening. A lower region 26 of each work head is formed as an annular array of with downward facing brush bristles 27 (best seen in FIG. 3).

Figure 3:
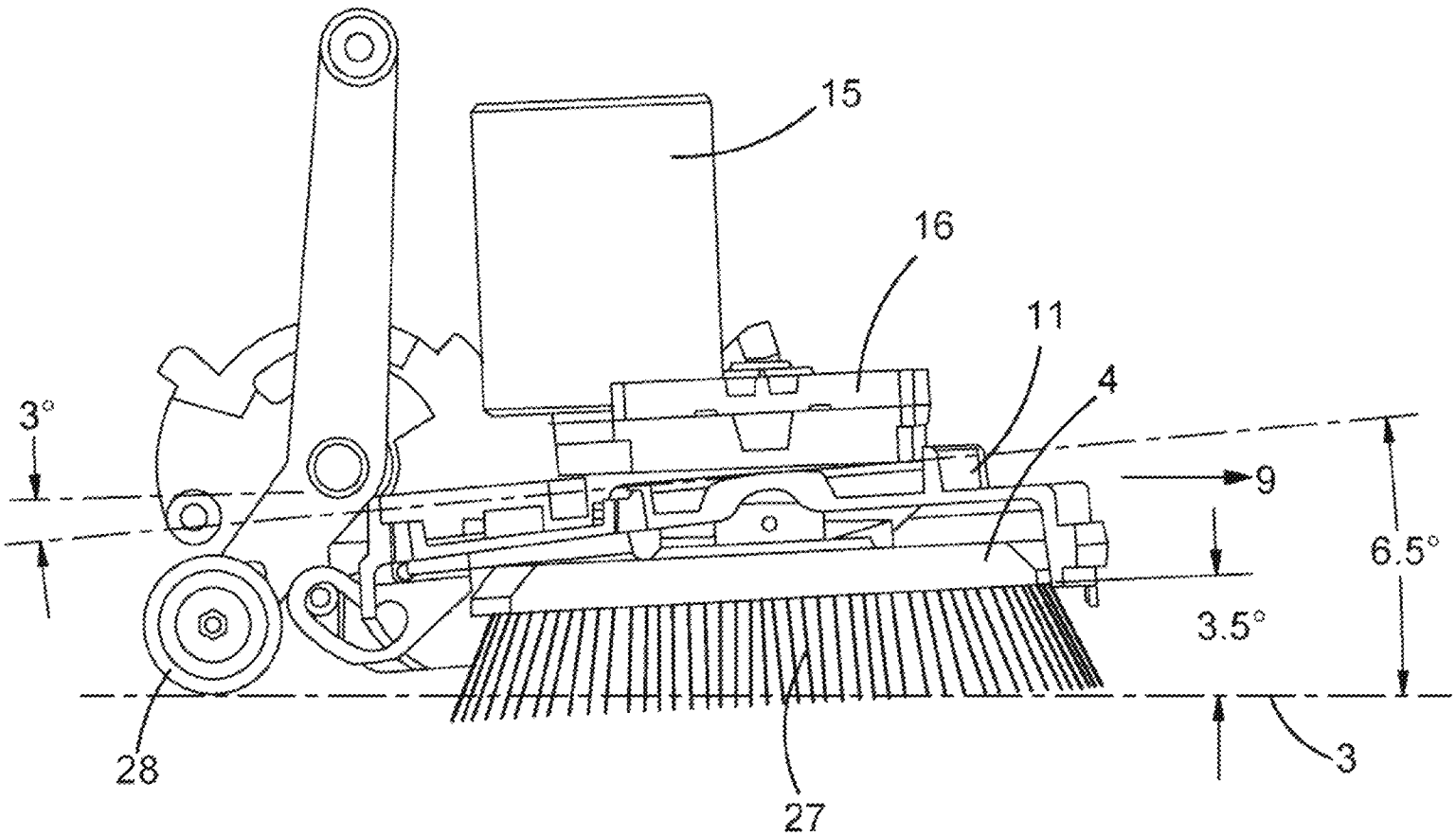
FIG. 3 is a side view of the deck assembly and machine components, showing the backward tilt.

In FIG. 3 the deck portion is shown integrated into the machine, with the housing omitted for the sake of clarity. A guide wheel 28 at the rear end region is one of a pair (other obscured). In this embodiment the backwards tilt of the deck portion with respect to the surface of the flat floor surface is 6.5 degrees. The net backwards tilt of the work head is 3.5 degrees, with 3 degrees of forward tilt being added by the fine tuning permitted by the threaded pillar/spacer connection between the deck and gearbox assembly 16. Generally the backward tilt of the work head (or its corresponding rotation axis) should be in the range 2.0 to 5.0 degrees, preferably 2.5 to 4.0 degrees, most preferably 3.0 to 3.5 degrees.

Figure 4:
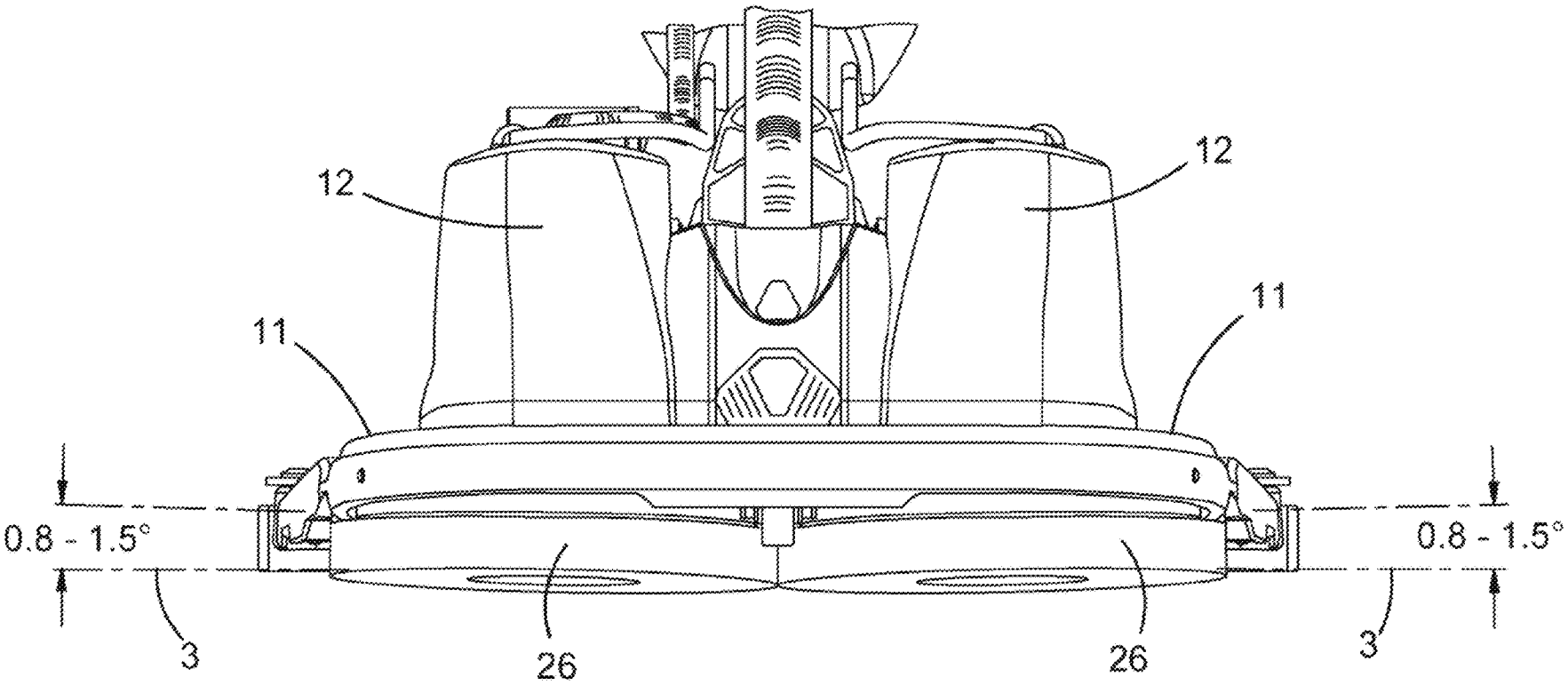
FIG. 4 is a front view of the machine showing the inward tilt of the work heads.

A front view of the machine is shown in FIG. 4. This view shows the slight transverse convergent tilt of the work head vertical rotation axes. Generally, the transverse tilt of each work head (or corresponding rotational axis) will typically be in the range 0.5 to 3 degrees, preferably 0.8 to 1.5 degrees, most preferably about 1.2 degrees.

Figure 5:
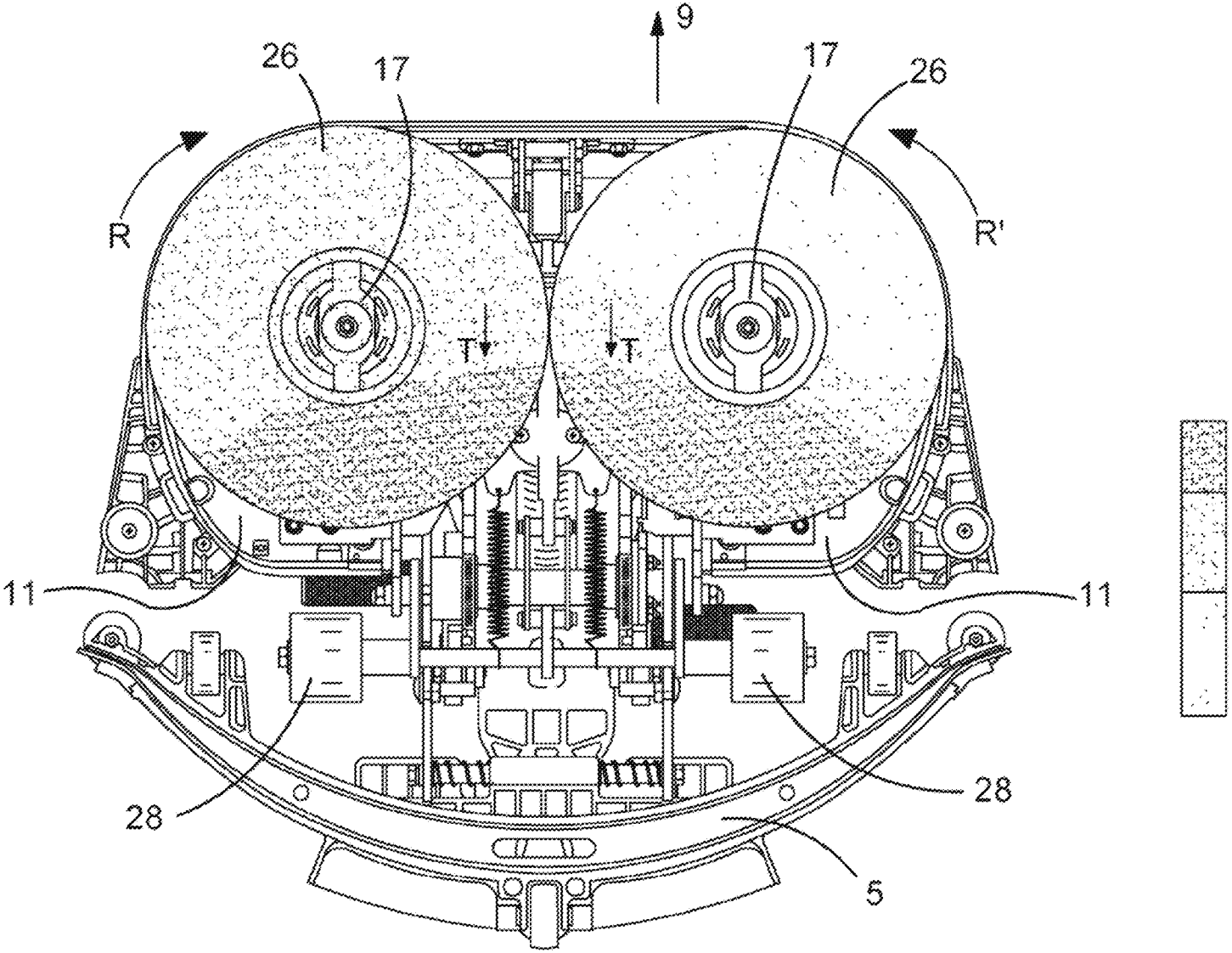
FIG. 5 is a plan view from below of the machine, with a pressure map provided for the two work heads.

The combination of transverse convergent tilt and backwards tilt of the workheads produces increased pressure on the floor surface due to the biasing of the brush bristles. A pressure map is visible in FIG. 5, with higher pressure indicated by the dark shading. The backwards and transverse tilts of the brushes produces increased pressure around the 4 o'clock to 10 o'clock positions of each work head. The rotation directions R and R' are clockwise and anti-clockwise respectively. This means that there is increased traction in the direction of the arrows T, T' in the inner regions of each work head brush. The results in a net forward propulsion in the working direction 9 during operation of the machine.

The rearward biasing compresses the bristles, and helps retain cleaning liquid within the confines of the annular work head brushes. The backward biassing ensures that there is more uniform cleaning pressure applied across the width of the two work heads, thereby improving the cleaning effect.

The present invention concerns the field of floor treatment machines such as scrubbers, finishers or polishers. Floor scrubbers typically have rotating work heads equipped with bristles for working the floor to remove dirt. The invention provides a floor treatment machine comprising a base portion provided with two or more rotatable generally disc-shaped floor-facing work heads which are arranged side-by-side on the floor and each having a generally vertical axis of rotation, the machine being provided with drive means for rotatably driving the work heads in counter-rotation with respect to one another, and wherein the rotational axes of both work heads are tilted transversely from their respective verticals so that the axes are convergent or divergent in opposite transverse directions thereby causing the work heads to adopt dihedral or dihedral configurations when viewed from a front of the machine, which configurations in use provide propulsion of the machine over the floor surface, wherein the respective work head axes are also both tilted backwards away from the vertical so that both work heads are tilted-up at front end regions thereof and depressed at rear end regions thereof with respect to the floor surface.

The invention claimed is:

1. A floor treatment machine comprising a base portion provided with two or more rotatable generally disc-shaped floor-facing work heads which are arranged side by side on the floor and each having a generally vertical axis of rotation, the machine being provided with drive means for rotatably driving the side by side work heads in counter-rotation with respect to one another, and wherein the rotational axes of both side by side work heads are tilted transversely from their respective verticals so that the axes are convergent or divergent in opposite transverse directions thereby causing the work heads to adopt dihedral or dihedral configurations when viewed from a front of the machine, which configurations in use provide propulsion of the machine over the floor surface, wherein the respective work head axes are also both tilted backwards away from the vertical so that both work heads are tilted-up at front end regions thereof and depressed at rear end regions thereof with respect to the floor surface.

2. A machine as claimed in claim 1 wherein the transverse tilt of work head axes is convergent so that work head pressure is enhanced at inner adjacent regions of each side-by-side work head.

3. A machine as claimed in claim 1 wherein the transverse tilt of work head axes is divergent so that work head pressure is enhanced at opposite outer regions of each side-by-side work head.

4. A machine as claimed in claim 1 wherein the work heads are carried underneath a deck portion.

5. A machine as claimed in claim 4 wherein the deck portion is configured to be tiltable with respect to the floor.

6. A machine as claimed in claim 5 wherein the deck portion is provided with biasing means which act to tilt the deck portion up at a front region and down at a rear region thereof, thereby to provide at least a portion of the backwards tilt of the work head axes.

7. A machine as claimed in claim 6 wherein the deck portion is configured to be tiltable with respect to a portion of the machine that is supported on the floor by wheel means.

8. A machine as claimed in claim 6 wherein a spring and/or weight moment provides or supplements or modifies the deck portion tilt biasing.

9. A machine as claimed in claim 8 wherein the drive means is disposed on the deck portion and provides or contributes to the weight moment.

10. A machine as claimed in claim 1 wherein each work head is attached to a drive shaft of a motor assembly for each work head.

11. A machine as claimed in claim 10 wherein the motor assemblies are attached to a deck portion, and one or more distributed spacer features interposed between the motor assembly and the deck portion act to provide a tilting effect of the attached drive shaft and work head with respect to the deck portion.

12. A machine as claimed in claim 1 wherein the machine is configured as a scrubber drier with scrubbing brush attachments provided on an underside of each work head, a cleaning liquid reservoir, a cleaning liquid dispenser provided in advance of, or under, each work head, and a suction squeegee device configured to be trailed behind the work heads for collecting liquid-entrained dirt.

13. A machine as claimed in claim 1 wherein the transverse tilt is in an amount within the range of 0.5 to 3 degrees.

14. A machine as claimed in claim 1 wherein the backwards tilt is within the range of 2.0 to 5.0 degrees.

15. A machine as claimed in claim 1 wherein the transverse tilt is in an amount within the range of 0.8 to 1.5 degrees.

16. A machine as claimed in claim 1 wherein the backwards tilt is within the range of 2.5 to 4.0 degrees.

17. A machine as claimed in claim 1 wherein the backwards tilt is within the range of 3.0 to 3.5 degrees.

* * * * *